US008555948B2

(12) United States Patent
Park

(10) Patent No.: US 8,555,948 B2
(45) Date of Patent: Oct. 15, 2013

(54) MULTIPURPOSE WINDOW

(76) Inventor: Jeong-won Park, Jinju-si (KR)

( * ) Notice: Subject to any disclaimer, the term of this patent is extended or adjusted under 35 U.S.C. 154(b) by 25 days.

(21) Appl. No.: 13/128,182

(22) PCT Filed: Nov. 5, 2009

(86) PCT No.: PCT/KR2009/006497

§ 371 (c)(1),
(2), (4) Date: May 6, 2011

(87) PCT Pub. No.: WO2010/053302

PCT Pub. Date: May 14, 2010

(65) Prior Publication Data

US 2011/0214348 A1 Sep. 8, 2011

(30) Foreign Application Priority Data

Nov. 7, 2008 (KR) ..... 10-2008-0110290
Feb. 9, 2009 (KR) ..... 10-2009-0010007
Sep. 29, 2009 (KR) ..... 10-2009-0092555

(51) Int. Cl.
*E05D 15/00* (2006.01)

(52) U.S. Cl.
USPC ..... 160/201; 160/172 R; 160/233

(58) Field of Classification Search
USPC ..... 160/172 R, 35, 36, 201, 207, 233
See application file for complete search history.

(56) References Cited

U.S. PATENT DOCUMENTS 702,146 A * 6/1902 McCloud ..... 160/147
1,965,262 A * 7/1934 Seregi ..... D25/48.7

(Continued)

FOREIGN PATENT DOCUMENTS

EP 1418307 A1 5/2004
JP 2002-061470 2/2002

(Continued)

OTHER PUBLICATIONS

Chinese Office Action issued on Dec. 21, 2012 in counterpart Chinese Patent Application No. 200980144756.8 (8 pages, in Chinese).

(Continued)

*Primary Examiner* — David Purol
(74) *Attorney, Agent, or Firm* — NSIP Law

(57) ABSTRACT

A multipurpose window having various functions including ventilation, lighting, and security is provided. The multipurpose window includes: a frame; a plurality of doors configured to be arranged in a row in the frame; and a pair of link assemblies configured to be installed on both sides of each of the doors, configured to link the doors and configured to open or shut the frame by being folded or unfolded. Each of the link assemblies includes: a plurality of first link elements configured to be installed on one side of each of the doors and include an outermost first link element, and that is hinged to the frame and one or more other first link elements that are slidably supported by the frame; a second link element configured to be hinged to a center of the outermost first link element and configured to be hinged to a near end of a first link element that is adjacent to the outermost first link element; a third link element configured to be hinged to a center of another outermost link element and configured to be hinged to a near end of a first link element that is adjacent to the another outermost first link element; and a fourth link element configured to be hinged to a center of a central first link element and to near ends of a pair of first link elements adjacent to the central first link element.

9 Claims, 22 Drawing Sheets

(56) References Cited

U.S. PATENT DOCUMENTS

| | | | | | |
|---|---|---|---|---|---|
| 2,149,301 | A | * | 3/1939 | Lawson | 160/170 |
| 2,188,300 | A | * | 1/1940 | Mishlenick | 160/144 |
| 2,389,956 | A | * | 11/1945 | Castilonia | 160/172 R |
| 2,557,978 | A | * | 6/1951 | Krumm | 160/34 |
| 2,621,723 | A | * | 12/1952 | Etten | 160/34 |
| 2,672,928 | A | * | 3/1954 | King, Jr. | 160/62 |
| 3,378,059 | A | * | 4/1968 | Young | 160/165 |
| 3,853,169 | A | * | 12/1974 | Music et al. | 160/172 R |
| 4,846,244 | A | * | 7/1989 | Rosenfeld | 160/201 |
| 4,850,417 | A | * | 7/1989 | Demukai et al. | 160/207 |
| 5,062,464 | A | * | 11/1991 | Peterson | 160/193 |
| 5,163,494 | A | * | 11/1992 | MacNeil et al. | 160/201 |
| 6,021,838 | A | * | 2/2000 | Taffe | 160/172 R |
| 6,035,917 | A | * | 3/2000 | Cohen-Ravid | 160/35 |
| 6,808,000 | B1 | * | 10/2004 | Peterson | 160/84.11 |
| 7,156,142 | B2 | * | 1/2007 | Peterson | 160/84.11 |

FOREIGN PATENT DOCUMENTS

| | | | |
|---|---|---|---|
| JP | 2005-105515 | | 4/2005 |
| KR | 20-0176175 | | 3/2000 |
| KR | 20-0239297 | | 9/2001 |
| KR | 10-0652920 | | 9/2005 |
| KR | 10-2008-0029458 | A | 4/2008 |
| KR | 10-2008-0029462 | | 4/2008 |
| KR | 10-0859526 | B1 | 9/2008 |

OTHER PUBLICATIONS

Japanese Office Action issued on Dec. 28, 2012 in counterpart Japanese Patent Application No. 2011-535510 (3 pages, in Japanese).

* cited by examiner

MULTIPURPOSE WINDOW

CROSS-REFERENCE TO RELATED APPLICATION(S)

This application claims the benefit under 35 U.S.C. §119 (a) of Korean Patent Applications No. 10-2008-0110290, 10-2009-0010007, and 10-2009-0092555, filed on Nov. 7, 2008, Feb. 9, 2009, and Sep. 29, 2009, respectively, in the Korean Intellectual Property Office, the entire disclosures of which are incorporated herein by reference for all purposes.

BACKGROUND

1. Field

The following description relates to a multipurpose window that is installed at the openings of a building, and more particularly, to a multipurpose window that can be used for various purposes not only including ventilation and lighting purposes but also including privacy protection and security purposes 2. Description of the Related Art In general, windows are largely classified into sliding windows and casement windows. Sliding windows are windows that can slid open or closed, and casement windows are windows that are hinged at the side and can swing inward or outward. Sliding windows generally require more space than casement windows to be installed. Casement windows may occupy more space than sliding windows when open, and may thus be less efficient than sliding doors in terms of the use of space. In addition, casement windows are likely to accidentally slam shut.

Conventional windows generally fail to prevent rain from coming in, thereby causing inconvenience. In addition, conventional windows often fail to maintain intimacy and privacy when open, thereby making people unwilling to open windows and ventilate their houses.

Particularly, glass windows are vulnerable to breaking and entering. To address this problem, window security bars may be installed on the outside of glass windows. The window security bars can prevent children from accidentally falling out even when the windows are open. However, the window security bars may fail to provide the people inside a sense of openness and freedom, and may make it difficult to escape through the windows in case of a fire or an emergency.

SUMMARY

The following description relates to a multipurpose window, which can be suitable for use for ventilation and security purposes, can relieve concerns over privacy protection, can prevent children from accidentally falling out, can allow people to climb out in case of an emergency, can be smoothly opened or closed, and can improve the efficiency of the use of space.

In one general aspect, there is provided a multipurpose window including: a frame; a plurality of doors configured to be arranged in a row in the frame; and a pair of link assemblies configured to be installed on both sides of each of the doors, configured to link the doors and configured to open or shut the frame by being folded or unfolded. Each of the link assemblies includes: a plurality of first link elements configured to be installed on one side of each of the doors and include an outermost first link element, and that is hinged to the frame and one or more other first link elements that are slidably supported by the frame; a second link element configured to be hinged to a center of the outermost first link element and configured to be hinged to a near end of a first link element that is adjacent to the outermost first link element; a third link element configured to be hinged to a center of another outermost link element and configured to be hinged to a near end of a first link element that is adjacent to the another outermost first link element; and a fourth link element configured to be hinged to a center of a central first link element and to near ends of a pair of first link elements adjacent to the central first link element.

Other features and aspects may be apparent from the following detailed description, the drawings, and the claims.

Figure 1:
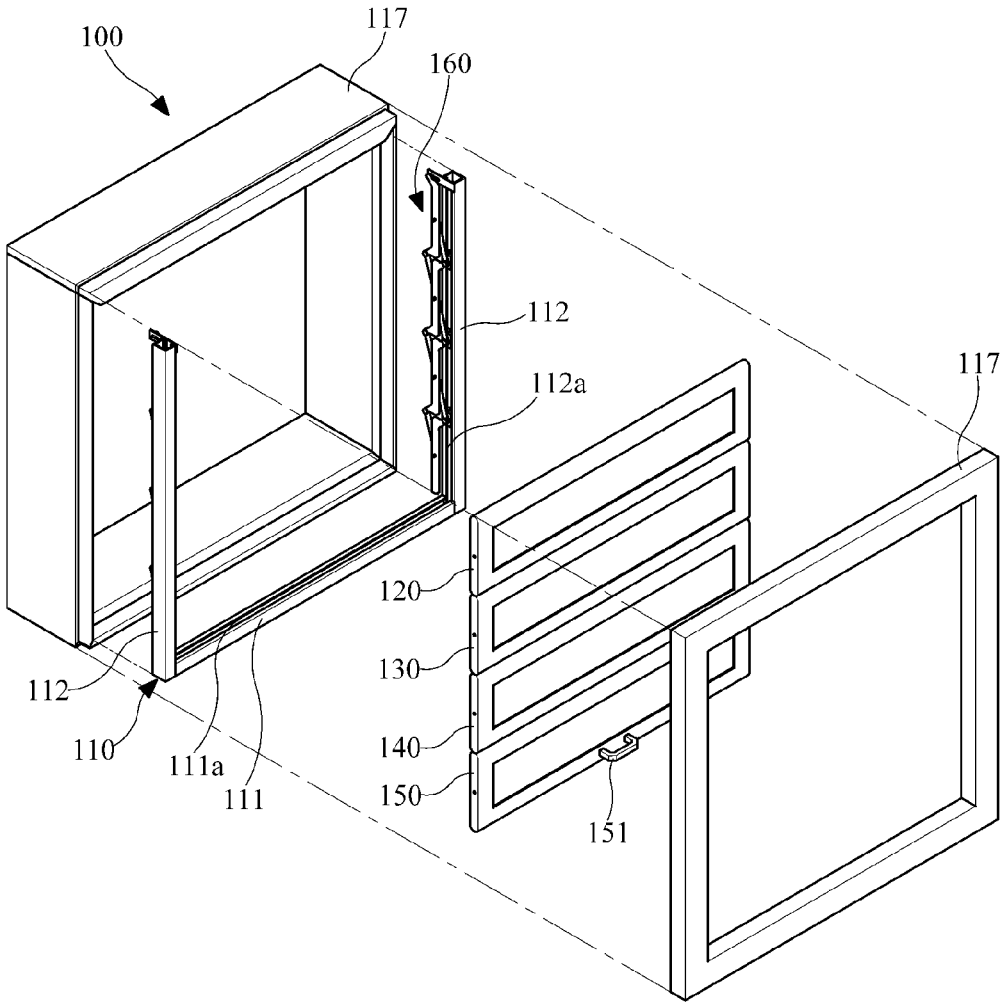
FIG. 1 is an exploded perspective view of an example of a multipurpose window.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein may be suggested to those of ordinary skill in the art. Also, descriptions of well-known functions and constructions may be omitted for increased clarity and conciseness.

Various aspects are directed to a multi-purpose window that can be applied to the roofs of buildings, the windows of buildings, plastic greenhouses, vehicles, vessels, or airplanes, various doors (including typical doors, fire doors, and the like), and the glass doors of large refrigerator, and that can be fitted to various sizes and places of installation.

Figure 2:
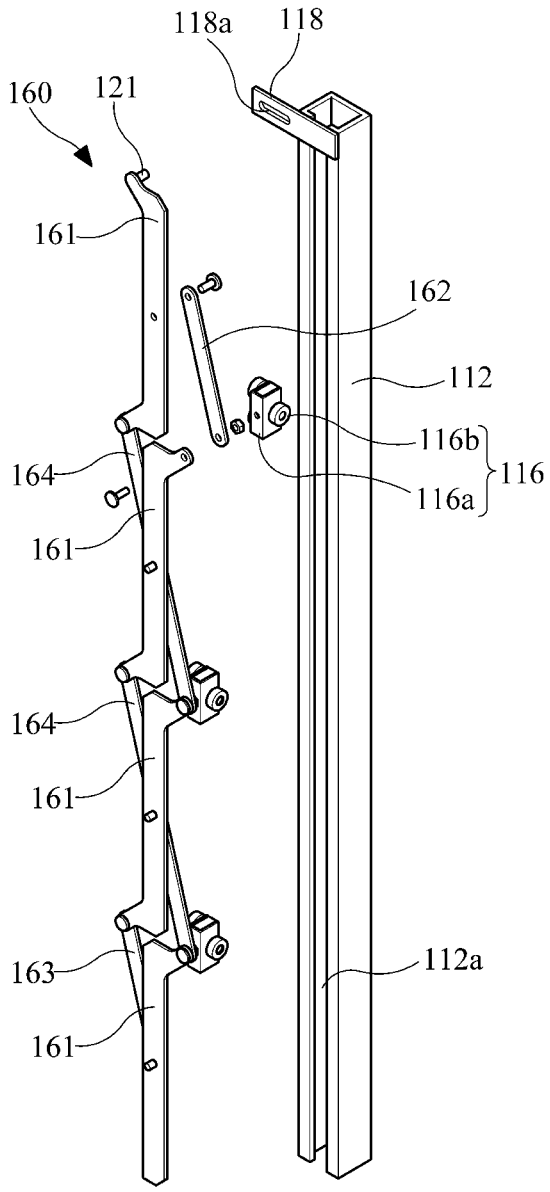
FIG. 2 is an exploded perspective view of an example of a link assembly illustrated in FIG. 1.

FIG. 1 illustrates an example of a multipurpose window, and FIG. 2 illustrates an example of a link assembly illustrated in FIG. 1.

Referring to FIGS. 1 and 2, multipurpose window 100 may include a frame 110, a plurality of doors 120, 130, 140, and 150, and a pair of link assemblies 160.

The frame 110 may include at least one horizontal element 111 and two vertical elements 112 that are connected to the horizontal element 111 and may have an open inner space in the middle. A vertical guide groove 112*a* may be formed on each of the inner sidewalls of the vertical elements 112. In response to the link assemblies 160 being folded or unfolded in the vertical elements 112, the vertical guide grooves 112*a* of the vertical elements 112 may guide the link assemblies 160 to slidably move up or down in the vertical elements 112. That is, the vertical guide grooves 112*a* may guide sliding elements 116 that are installed at the upper ends of first link elements 161, but not at the upper ends of uppermost first link elements 161, to slide up or down in the vertical elements 112.

The vertical guide grooves 112*a* may extend in the direction of the length of the vertical elements 112 so that the sliding elements 116 can slide up or down in the vertical elements 112. The vertical guide grooves 112*a* may have a narrow opening so that the sliding elements 116 cannot be easily detached from the vertical guide grooves 112*a* while sliding up or down in the vertical elements 112.

A horizontal guide groove 111*a* may be formed in the horizontal element 111, which forms a lower part of the frame 110. In response to the frame 110 being shut, the horizontal guide groove 111*a* may maintain a lowermost door 150 to be inserted thereinto. The frame 110 may be formed of an aluminum material, and may be supported by a supporting element 117.

The supporting element 117 may surround the circumference of the frame 110, and may be fixed into an opening of, for example, a building. Accordingly, the frame 110 may be easily installed in an opening of, for example, a building, by the supporting element 117. In a case in which the multipurpose window 100 also includes a reciprocating device 180, the supporting element 117 may also support the reciprocating device 180. The supporting element 117 may be formed of wood.

The doors 120, 130, 140, and 150 may be arranged in a row in the frame 110. The doors 120, 130, 140, and 150 may have such a size that they can completely shut the frame 110 when vertically aligned with one another. The lowermost door 150 may include a doorknob 151. The doorknob 151 may be installed on the door 150 to face the inside of the room. Accordingly, a user in the room can use the doorknob 151 to lift the door 150 up or down.

In response to the multipurpose window 100 being used as a window, the doors 120, 130, 140, and 150 may be configured to be glass windows that can shut the frame 110 and improve lighting. The multipurpose window 100 is illustrated in FIG. 1 as including four doors are illustrated in FIG. 1, but are not restricted to this. That is, the multipurpose window 100 may include more than four or less than four doors according to their purpose of use.

The link assemblies 160 may link the doors 120, 130, 140, and 150 and may be configured to be folded or unfolded to open or shut the frame 110. The link assemblies 160 may be installed on either side of the doors 120, 130, 140, and 150. Each of the link assemblies 160 may include a plurality of first link elements 161, a second link element 162, a third link element 163, and a plurality of fourth link elements 164.

The first link elements 161 may be installed on both sides of each of the doors 120, 130, 140, and 150. In response to the multipurpose window 100 including four doors, a total of eight first link elements 161 may be provided. The first link elements 161 may be arranged along and fixed to both sides of each of the doors 120, 130, 140, and 150. The upper ends of a pair of first link elements 161 at the top of the link assemblies 160, i.e., the uppermost first link elements 161, may be hinged to the frame 110, and the upper ends of other pairs of first link elements 161 may be supported by the frame 110 so as to be able to slide up or down in the frame 110.

For example, the upper ends of a pair of uppermost first link elements 161 may be hinged to the frame 110, and the upper ends of three pairs of first link elements 161 may be supported by the frame 110 so as to be able to slide up or down in the frame 110. The three pairs of first link elements 161 may be hinged to their respective sliding elements 116.

The sliding elements 116 may allow the link assemblies 160 to smoothly slide up or down in the frame 110 while being folded or unfolded in the frame 110. The sliding elements 116 may have various structures. For example, each of the sliding elements 116 may include a main body 116*a* to which a link assembly 160 is coupled, and a plurality of rollers 116*b* that guide the main body 116*a* to smoothly slide up or down inside the vertical guide groove 112*a* of a vertical element 112. The rollers 116*b* may be installed on the main body 116*a* so that they can roll on the inner sidewalls of the vertical guide groove 112*a* of the vertical element 112.

The second link element 162 may be hinged to the center of an uppermost first link element 161 and to the upper end of a first link element 161 directly behind the uppermost first link element 161.

For example, the multipurpose window 100 may include two second link elements 162 that are disposed on either side of the door 120. In this example, the second link element 162 on the left side of the door 120 may be hinged to the center of an uppermost first link element 161 on the left side of the door 120 and to the upper end of a first link element 161 directly behind the uppermost first link element 161. The second link element 162 on the right side of the door 120 may be hinged to a pair of upper first link elements 161 on the right side of the door 120 in the same manner as the second link element 162 on the left side of the door 120.

The third link element 163 may be hinged to the center of a lowermost first link element 161 and to the lower end of a first link element 161 directly above the lowermost first link element 161.

For example, the multipurpose window 100 may include two third link elements 163 that are disposed on either side of the door 150. For example, the third link element 163 on the left side of the door 150 may be hinged to the center of a lowermost first link element 161 on the left side of the door 150 and to the lower end of a first link element 161 directly above the lowermost first link element 161. The third link element 163 on the right side of the door 150 may be hinged to a pair of lower first link elements 161 on the right side of the door 150 in the same manner as the third link element 163 on the left side of the door 150.

The fourth link elements 164 may be hinged to the center of a first link element 161 in the middle of a link assembly 160, to the upper end of a first link element 161 directly below the first link element 161 in the middle of the link assembly 160, and to the lower end of a first link element 161 directly above the first link element 161 in the middle of the link assembly 160.

For example, the multipurpose window 100 may include four fourth link elements 164, i.e., a pair of fourth link elements 164 on the left sides of the doors 130 and 140 and another pair of fourth link elements 164 on the right sides of the doors 130 and 140.

The fourth link element 164 on the left side of the door 130 may be hinged to the center of the first link element 161 on the left side of the door 130, the upper end of the first link element 161 on the left side of the door 140, and the lower end of the first link element 161 on the left side of the door 120.

The fourth link element 164 on the left side of the door 140 may be hinged to the center of the first link element 161 on the left side of the door 140, the upper end of the first link element 161 on the left side of the door 150, and the lower end of the first link element 161 on the left side of the door 130. The fourth link elements 164 on the right sides of the doors 130 and 140 may be hinged to the first link elements 161 on the right sides of the doors 120, 130, 140, and 150 in the same manner as the fourth link elements 164 on the left sides of the doors 130 and 140.

The length of the second link elements 162, the length of the third link elements 163, and the length of the fourth link elements 164 may be determined such that the doors 120, 130, 140, and 150 can be vertically aligned with one another in response to the link assemblies 160 folding out, and that the doors 120, 130, 140, and 150 can be inclined by the same angle in response to the link assemblies 160 contracting. For example, the length of the second link elements 162 and the length of the third link elements 163 may be half the length of the first link elements 161. The length of the fourth link elements 164 may be the same as the length of the first link elements 161. In a case in which the multipurpose window 100 includes only two doors, the fourth link elements 164 may be optional.

Figure 3:
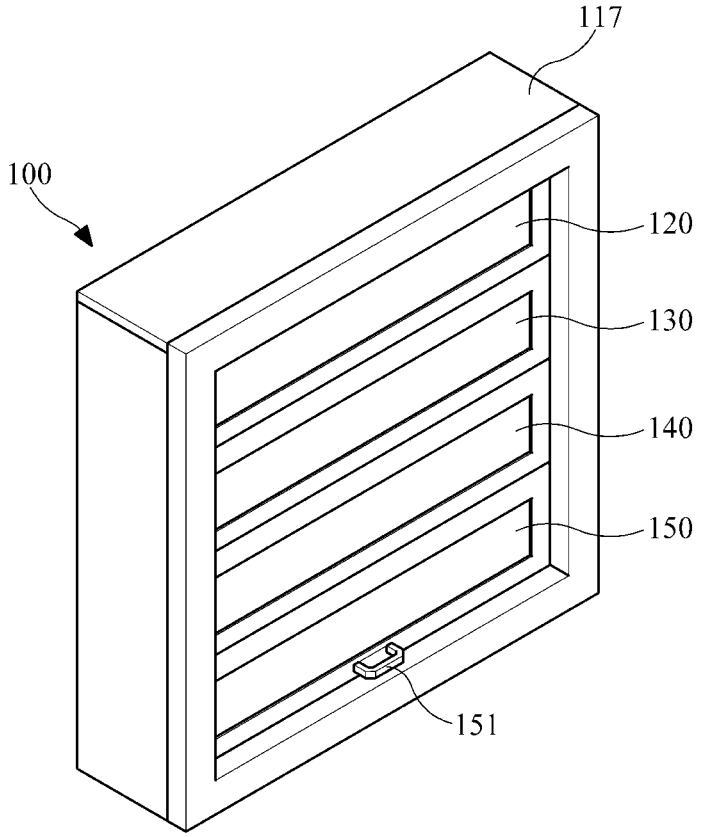
FIGS. 3 and 4 are a perspective view and a side view, respectively, of an example of the multipurpose window illustrated in FIG. 1 in a closed state.
Figure 4:
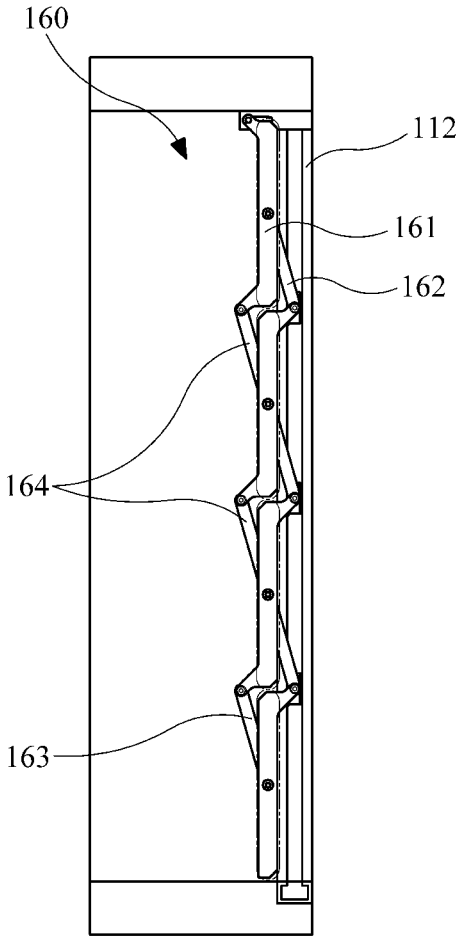

In response to a user completely unfolding the link assemblies 160 by lifting down the door 150, as illustrated in FIGS. 3 and 4, the doors 120, 130, 140, and 150 may be completely closed, and may be vertically aligned with one another so that no gaps can be left between the frame 110 and the doors 120, 130, 140, and 150 and between the doors 120, 130, 140, and 150. Accordingly, the multipurpose window 100 may provide protection against wind and security.

Figure 5:
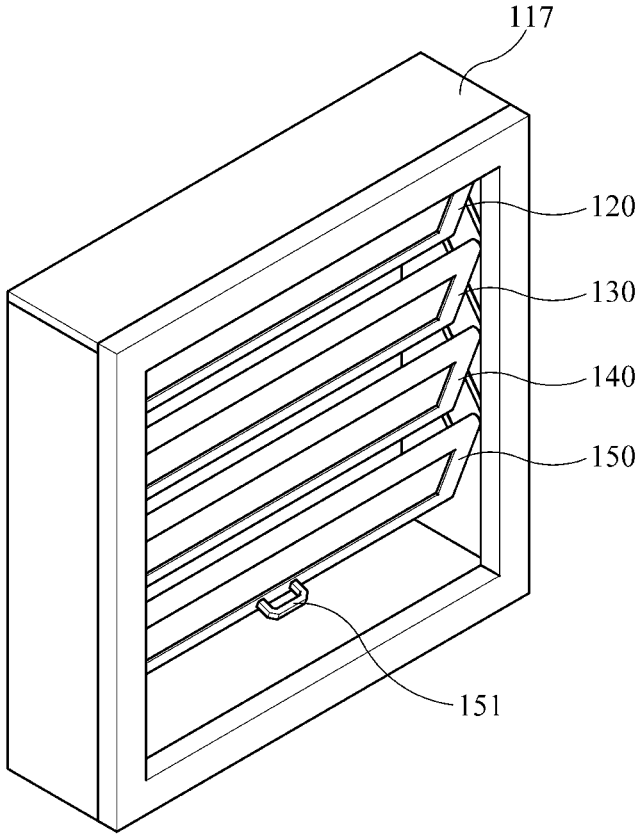
FIGS. 5 and 6 are a perspective view and a side view, respectively, of an example of the multipurpose window illustrated in FIG. 1 in a partially-open state.
Figure 6:
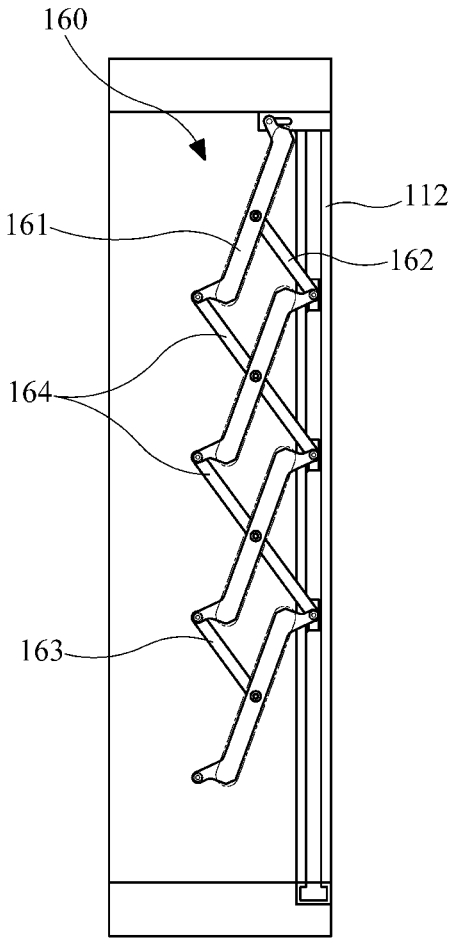

In response to the user folding the link assemblies 160 by lifting up the door 150, as illustrated in FIGS. 5 and 6, the doors 120, 130, 140, and 150 may all be pivoted open, and the doors 130, 140, and 150 may be lifted up. Accordingly, the frame 110 may be opened at a lower part of the multipurpose window 100 and between the doors 120, 130, 140, and 150 so that air can be properly circulated therethrough.

The link assemblies 160 may be installed to face the outside of the room. In this example, in response to the doors 120, 130, 140, and 150 being opened, the doors 120, 130, 140, and 150 may be inclined outwardly in parallel with one another. Accordingly, it is possible to prevent rain from coming in and improve ventilation. In addition, it is possible to relieve concerns over privacy protection and save costs for heating and air-conditioning by ventilating the room without compromising privacy and security.

Moreover, by controlling the extent to which the doors 120, 130, 140, and 150 are opened, it is possible to control ventilation, prevent break-ins and prevent children from falling out. Furthermore, the multipurpose window 100 produces a more excellent appearance and a better sense of openness and freedom than window security bars.

Figure 7:
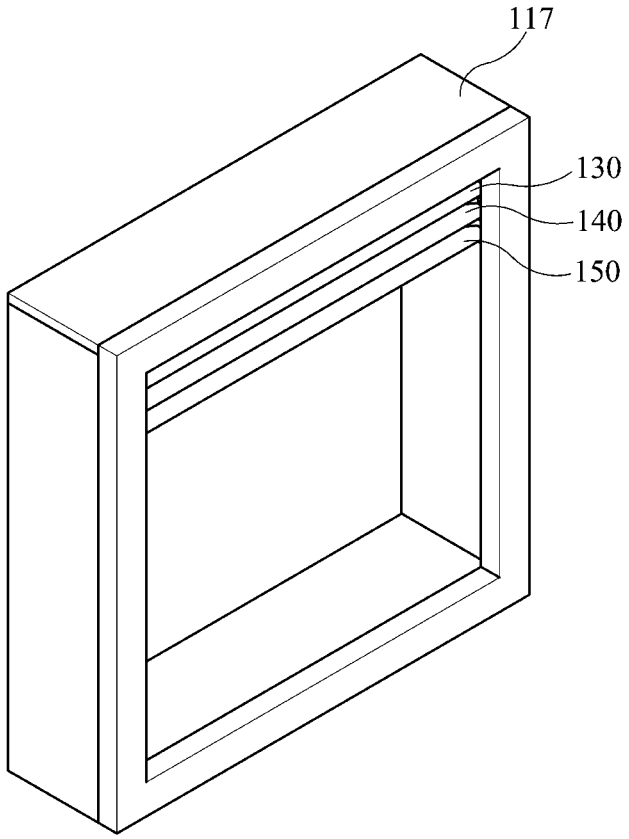
FIGS. 7 and 8 are a perspective view and a side view, respectively, of an example of the multipurpose window illustrated in FIG. 1 in a fully open state.
Figure 8:
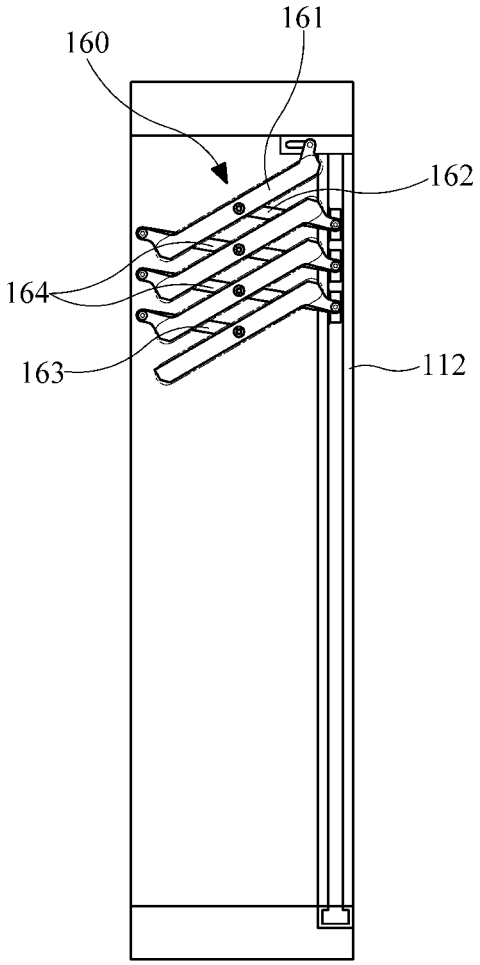

In response to the user completely lifting up the door 150 by completely folding the link assemblies 160, as illustrated in FIGS. 7 and 8, the doors 120, 130, 140, and 150 may be folded over one another, and the frame 110 may be opened to its maximum extent. In this example, it is possible to further improve ventilation and to allow people to climb out in case of a fire or an emergency.

In response to the frame 110 being open, the doors 120, 130, 140, and 150 may simply protrude beyond the back of the frame 110 while still contained in the frame 110. Accordingly, the multipurpose window 110 may require less space for installation and improve the use of space, as compared to traditional sliding and casement windows.

The first link elements 161 may be configured to, in response to the link assemblies 160 being unfolded to close the doors 120, 130, 140, and 150, as illustrated in FIG. 4, prevent the second link elements 162 and the fourth link elements 163 from interfering with each other and prevent the third link elements 163 and the fourth link elements 164 from interfering with each other. In this example, one or both ends of each of the first link elements 161 that are hinged to one another and/or to the second link elements 162, the third link elements 163, and the fourth link elements 164 may be formed to have an extension that protrudes toward or away from the doors 120, 130, 140, and 150.

For example, referring to FIG. 2, the lower end of an uppermost first link element 161 may be formed to have an extension that protrudes away from the door 120. The upper ends of middle first link elements 161 may be formed to have an extension that protrudes toward the doors 130 and 140, and the lower ends of the middle first link elements 161 may be formed to have an extension that protrudes away from the doors 130 and 140. The upper end of a lowermost first link element 161 may be formed to have an extension that protrudes toward the door 150.

The uppermost first link element 161 may be configured to move backward and forward inside the frame 110. For example, a guide piece 118 may be provided at the upper end of a vertical element 112 of the frame 110. A slot hole **118*a* that extends horizontally may be formed across the guide piece 118**.

The upper end of the uppermost first link element 161 may be formed to have an extension that protrudes away from the door 120, and a connecting axis 121 may be installed on the extension. The connecting axis 121 may be installed to allow the uppermost first link element 161 to move forward and backward along the slot hole **118*a* of the guide piece 118. The connecting axis 121 may be moved backward along the slot hole 118*a* in response to the link assembly 160 being folded, and may be moved forward along the slot hole 118*a* in response to the link assembly 160 being unfolded. Due to the connecting axis 121, the doors 120, 130, 140, and 150** may be smoothly opened or closed.

Figure 9:
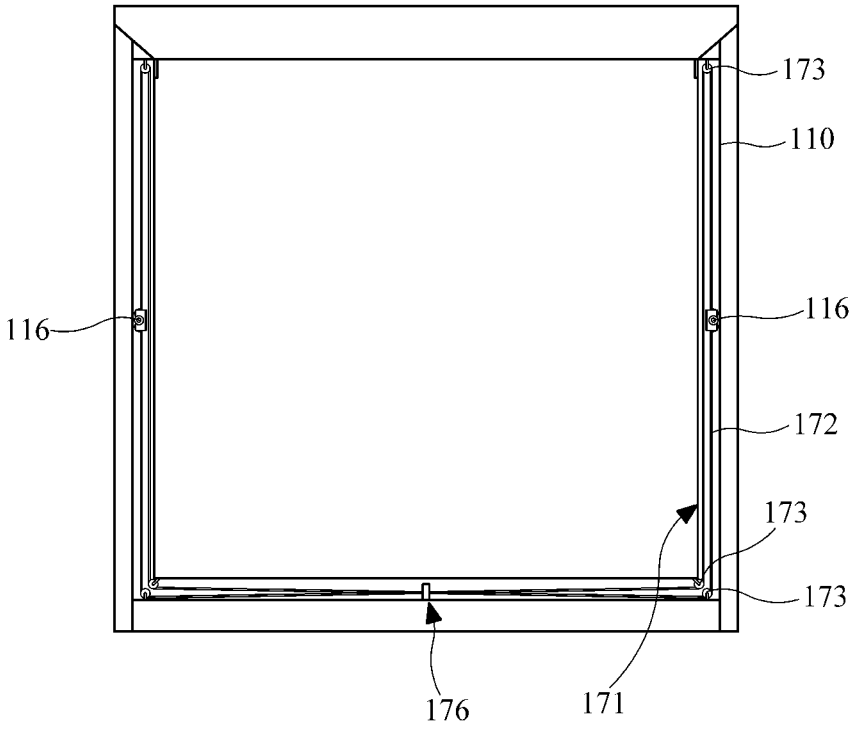
FIG. 9 is a front view illustrating an example of the multipurpose window illustrated in FIG. 1, including a balancing device.

The multipurpose window 100 may also include a balancing device 171 to allow the doors 120, 130, 140, and 150 to be pivoted open or closed in a balanced manner and a braking device 176 to put a brake on the doors 120, 130, 140, and 150 to stop the doors 120, 130, 140, and 140 at a predefined position. Referring to FIG. 9, the balancing device 171 may include wires and a plurality of pulleys 173.

The wires 172 may be fixed to both sides of one of the doors 120, 130, 140, and 150. For example, the wires 172 may be fixed to a pair of sliding elements 116 installed on both sides of the door 150. In this example, the wires 172 may form a closed loop by extending, along the frame 110, from their left fixed parts to all the way down to the bottom of the frame 110, to all the way up to the upper right corner of the frame 110, to their fixed right parts, to all the way down to the bottom of the frame 110, to all the way up to the upper left corner of the frame 110, and to their left fixed parts.

The pulleys 173 may be installed in the frame 110, and may guide the movement of the wires 172. For example, three pulleys 173 may be provided in the frame 110: one pulley 173 at the lower left corner of the frame 110, another pulley 173 at the upper right corner of the frame 110, and the other pulley 173 at the lower right corner of the frame 110. In this example, the wires 172 may be guided to extend, along the frame 110, from their left fixed parts to their right fixed parts through the lower left and upper right corners of the frame 110. For example, three pulleys 173 may also be provided in the frame 110: one pulley 173 at the lower right corner of the frame 110, another pulley 173 at the upper left corner of the frame 110, and the other pulley 173 at the lower left corner of the frame 110. In this example, the wires 172 may be guided to extend, along the frame 110, from their right fixed parts to their left fixed parts through the lower right and upper left corners of the frame 110.

Due to the balancing device 171, both sides of the door 150 may be elevated to the same height in response to the door 150 being lifted up. That is, the balancing device 171 may elevate the door 150 in a balanced manner. As a result, the doors 120, 130, and 140 that are connected to the door 150 by the link assemblies 160 may also be elevated in a balanced manner.

Figure 10:
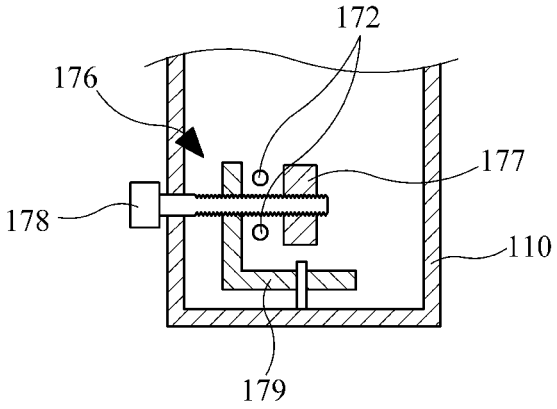
FIG. 10 is a side view illustrating an example of the multipurpose window illustrated in FIG. 1, including a braking device.

Referring to FIG. 10, the braking device 176 may include a pressing element 177 and a manipulation lever 178. The pressing element 177 may be disposed to correspond to an intersection of the wires 172.

The manipulation lever 178 may attaches firmly or detaches the pressing element 177 to or from the wires 172. The manipulation lever 178 may be screw-coupled into the frame 110 from the inside of the room, and the pressing element 177 may be fixed to a part of the manipulation lever 178 that is inserted in the frame 110. An auxiliary bracket 179 may also be installed in the frame 110. The auxiliary bracket 179 may allow the wires 172 to be stably pressed by the pressing element 177, and may allow the manipulation lever 178 to be stably screw-coupled into the frame 110.

For example, in response to the frame 110 being open to a predefined extent, the user may stop the wires 172 from moving by rotating the manipulation lever 178 to firmly attach the pressing element 177 to the intersection of the wires 172. In this example, the doors 120, 130, 140, and 150 may be fixed to a predefined position. As another example, in response to the frame 110 being shut, the user may stop the wires 172 from moving by rotating the manipulation lever 178 to firmly attach the pressing element 177 onto the intersection of the wires 172. In this example, the doors 120, 130, 140, and 150 may be locked.

In response to the user rotating the manipulation lever 178 to detach the pressing element 177 from the intersection of the wires 172, the wires 172 may be unstopped, and the doors 120, 130, 140, and 150 may be allowed to be elevated freely.

Figure 11:
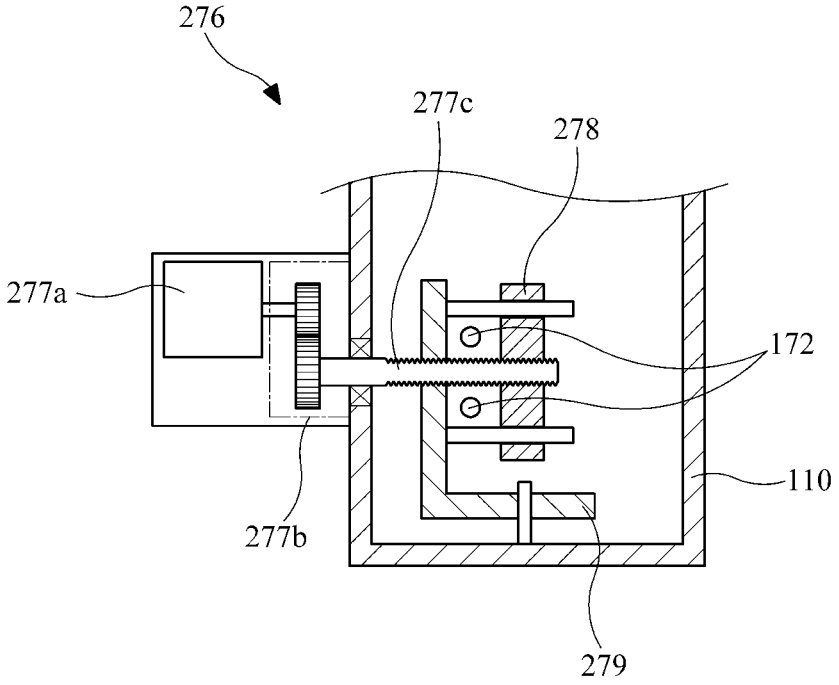
FIG. 11 is a side view illustrating a variation of the braking device illustrated in FIG. 10.

FIG. 11 illustrates another example of the braking device 176. Referring to FIG. 11, a braking device 276 may include a rotation motor 277*a*, a pressing element 278, and an auxiliary bracket 279. The rotation motor 277*a* may be attached to the outside of the frame 110 using a bracket such that the rotation axis of the rotation motor 277*a* can face the frame 110. The rotation motor 277*a* may rotate forward and backward, and may be controlled by a remote control.

The rotation speed of the rotation motor 277*a* may be reduced by a decelerator 277*b*. The decelerator 277*b* may include a plurality of reduction gears. Referring to the reduction gears, a driving reduction gear may be coupled to the rotation axis of the rotation motor 277*a*, and a driven reduction gear may be coupled to a driving axis 277*c*. The driving axis 277*c* may protrude from the decelerator 277*b* and may be inserted into the frame 110.

The pressing element 278 may be disposed to correspond to the intersection of the wires 172. The pressing element 278 may be screw-coupled to the driving axis 277*c*, and may be attached firmly to or detached from the wires 172 according to the rotation direction of the driving axis 277*c*.

The auxiliary bracket 279 may be formed in the frame 110 to support the driving axis 277*c* and to guide the movement of the pressing element 278. For example, the auxiliary bracket 279 may support the driving axis 277*c* by being penetrated by the driving axis 277*c*. For example, the auxiliary bracket 279 may include a plurality of guide pins that are inserted into a plurality of guide holes formed through the pressing element 278 and may guide the movement of the pressing element 278.

In response to the user controlling the rotation motor 277*a* using a remote control, the braking device 276 may automatically attach the pressing element 278 to the wires 172 or automatically detach the pressing element 278 from the wires 172. For example, in response to the braking device 276 firmly attaching the pressing element 278 to the wires 172, the doors 120, 130, 140, and 150 may be fixed to a predefined position. As another example, in response to the braking device 276 firmly attaching the pressing element 278 to the wires 172 with the frame 110 shut, the doors 120, 130, 140, and 150 may be locked.

The multipurpose window 100 may also include a shock-absorbing device to prevent accidents that may be caused by abruptly opening or closing the doors 120, 130, 140, and 150. Due to the shock-absorbing device, the doors 120, 130, 140, and 150 may be smoothly opened or closed.

Figure 12:
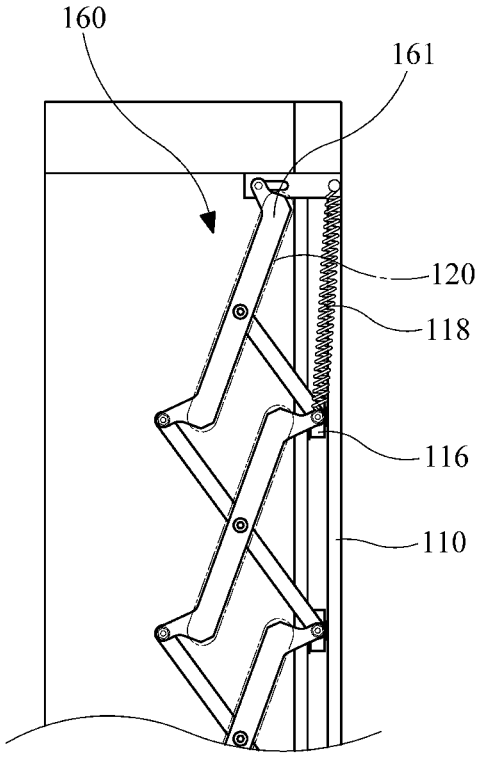
FIG. 12 is a side view illustrating an example of the multipurpose window illustrated in FIG. 1, including a shock-absorbing device.

For example, referring to FIG. 12, the shock-absorbing device may be a coil spring 118. One end of the coil spring 118 may be coupled to the upper end of a vertical element 111 of the frame 110, and the other end of the coil spring 118 may be coupled to an uppermost sliding element 116. The coil spring 118 may extend or contract in response to the doors 120, 130, 140, and 150 being opened or closed. The elastic force that is generated by the extension and the contraction of the coil spring 118 may absorb shock.

Figure 13:
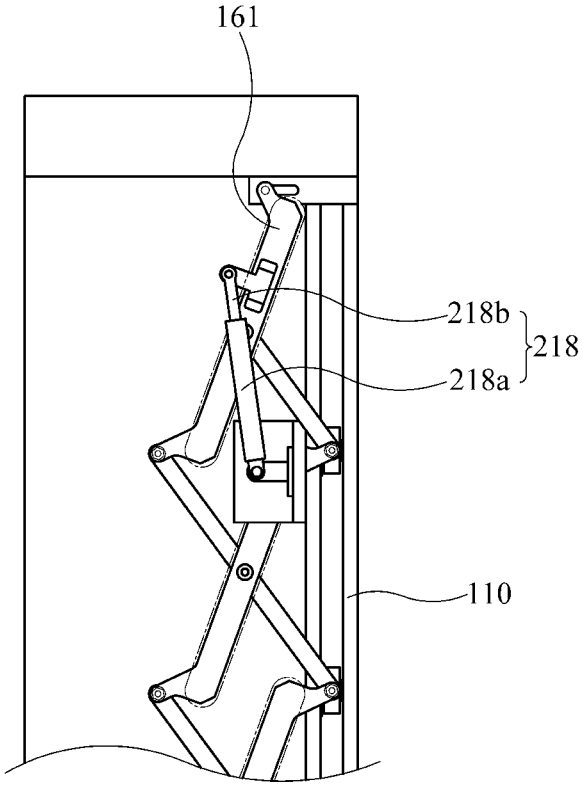
FIGS. 13 and 14 are side views of variations of the shock-absorbing device illustrated in FIG. 12.
Figure 14:
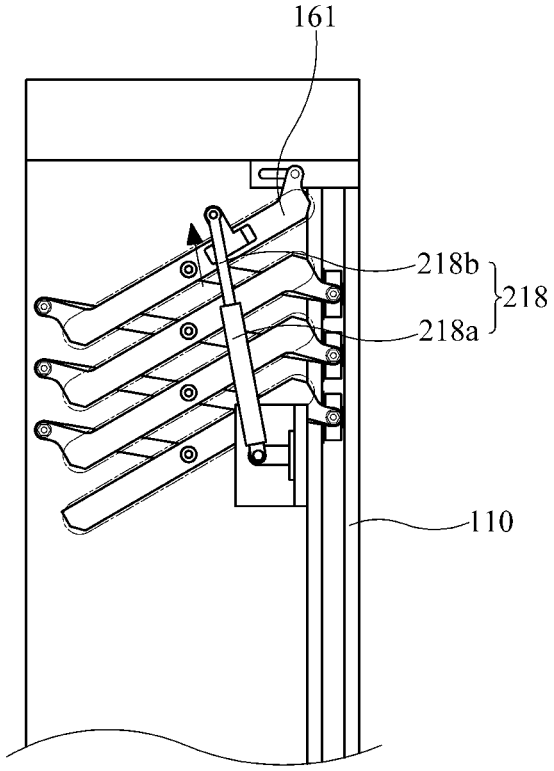

As another example, referring to FIGS. 13 and 14, the shock-absorbing device may be a shock absorber 218. The shock absorber 218 may include a cylinder body 218*a* and a cylinder rod 218*b* that can extend from or retract into the cylinder body 218*a*. The cylinder body 218*a* may be rotatably hinged to the frame 110 or the supporting element 117. One end of the cylinder rod 218*b* may be hinged to one side of an uppermost first link element 161. In response to the doors 120, 130, 140, and 150 being opened or closed, the cylinder rod 218*b* may extend from or retract into the cylinder body

218*a*. The resisting force that is generated by the extension and the retraction of the cylinder rod 218*b* may absorb shock. The shock-absorbing device may be implemented in various manners and is not restricted to the examples set forth herein.

Figure 15:
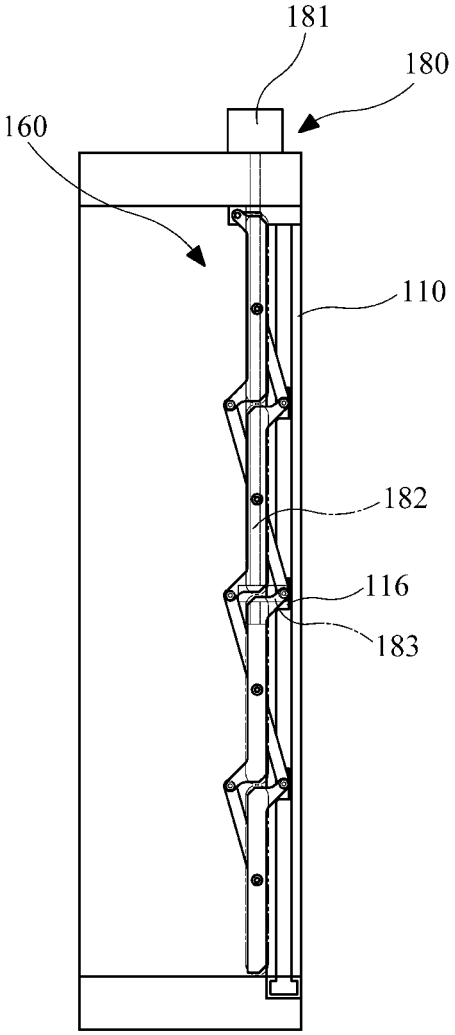
FIGS. 15 and 16 are side views illustrating examples of the multipurpose window illustrated in FIG. 1, including a reciprocating device.
Figure 16:
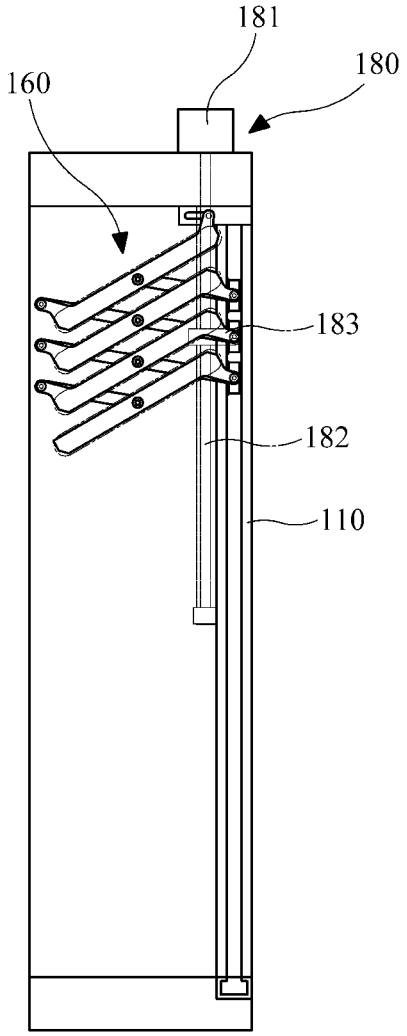

The multipurpose window 100 may also include the reciprocating device 180 that automatically opens or shuts the frame 110. Referring to FIGS. 15 and 16, the reciprocating device 180 may be configured to elevate one end of one of a plurality of first link elements 161 that are slidably supported by the frame 110. For example, the reciprocating device 180 may include a rotation motor 181, a ball screw 182, and a reciprocating element 183.

The rotation motor 181 may be located on one of the upper left end the upper right end of the frame 110. The rotation motor 181 may be installed on the supporting element 117 such that and the rotation axis of the rotation motor 181 can face downwards. The rotation motor 181 may rotate forward and backward, and may be controlled by a remote control.

One end of the ball screw 182 may be fixed to the rotation axis of the rotation motor 181. The ball screw 182 may be installed vertically into the supporting element 117. A lower end of the ball screw 182 may be supported by the supporting element 117. The rotation speed of the rotation motor 182 may be reduced by a decelerator. In this example, the ball screw 182 may be fixed to a driving axis that is decelerated and rotated by the decelerator.

The reciprocating element 183 may be screw-coupled to the ball screw 182, and may be connected to a sliding element 116 that is installed on any first link element 161 but an uppermost first link element 161.

For example, to balance between the driving load of the rotation motor 181 and the speed of opening or shutting the frame 110, the reciprocating element 183 may be connected to a sliding element 116 that is installed on a second uppermost first link element 161. If the reciprocating element 183 is connected to a sliding element 116 that is installed on the uppermost first link element 161, the speed of opening or shutting the frame 110 may increase, but the driving load of the rotation motor 181 may also increase. If the reciprocating element 183 is connected to the sliding element 116 that is installed on a third uppermost first link element 161, the driving load of the rotation motor 181 may decrease, but the speed of opening or shutting the frame 110 may also decrease.

In response to the ball screw 182 being rotated forward or backward by the rotation motor 181, the reciprocating element 183 may be elevated, and a sliding element 116 that is connected to the reciprocating element 183 may also be elevated. Accordingly, the door 130 that is connected to the sliding element 116 may be automatically elevated, and the doors 120, 140, and 150 that are connected to the door 130 by the link assemblies 160 may also be automatically elevated.

Figure 17:
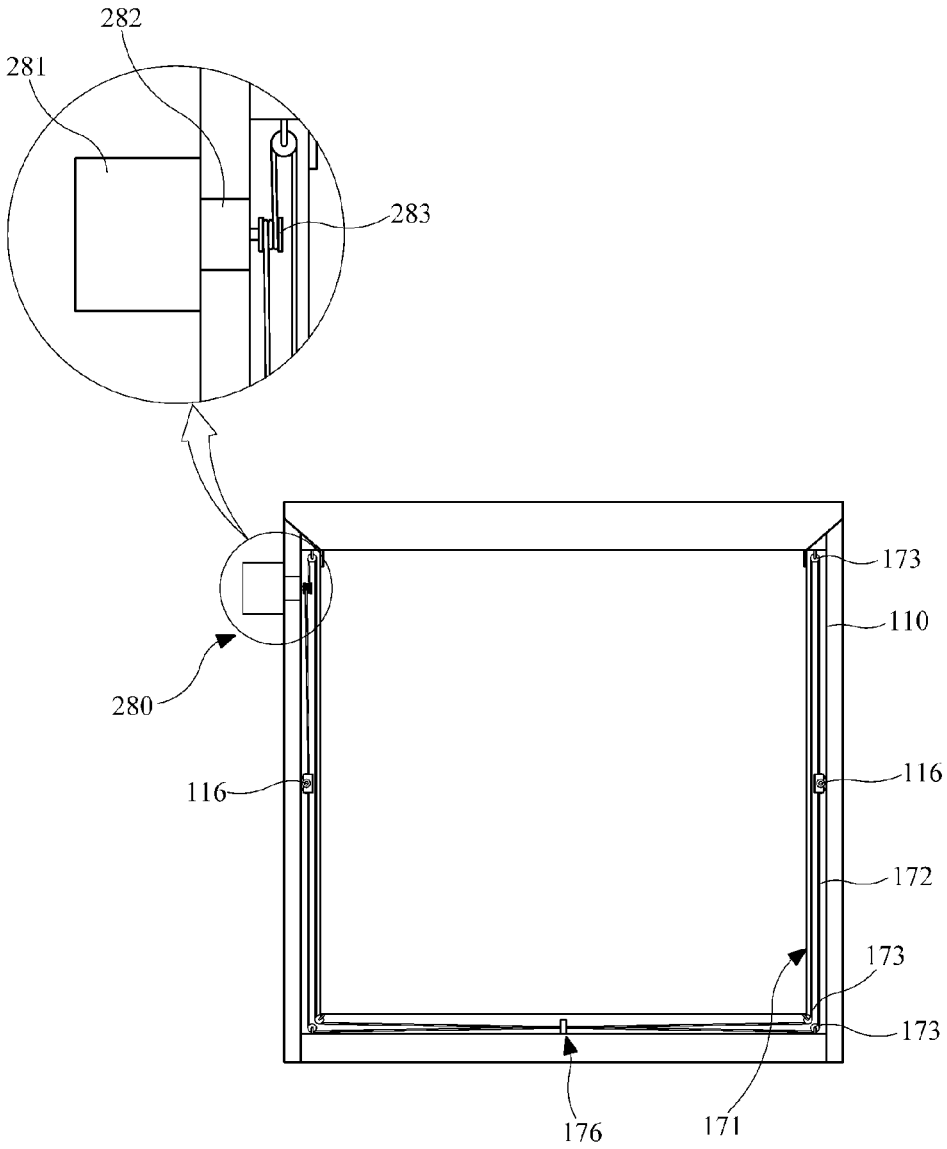
FIG. 17 is a front view illustrating an example of the multipurpose window illustrated in FIG. 10, including a variation of the reciprocating device illustrated in FIG. 15 or 16.

FIG. 17 illustrates another example of the reciprocating device 180. Referring to FIG. 17, a reciprocating device 280 may move the wires 172 of the balancing device 171 in two opposite directions to allow the frame 110 to be automatically opened or shut. The reciprocating device 280 may include a rotation motor 281, a decelerator 282, and a pulley 283.

The rotation motor 281 may rotate forward and backward, and may be controlled by a remote control. The decelerator 282 may reduce the rotation speed of the rotation motor 281. The pulley 283 may be fixed to a driving axis that is decelerated and rotated by the decelerator 282. The pulley 283 may be fixed to the driving axis, and may rotate along with the driving axis. The wires 172 may be wound at least once around the pulley 283. The wires 172 may be wound around the pulley 283 such that one end of the wires 172 can be unwound from the pulley 283 in response to the other end of the wires 172 being wound around the pulley 283. The wires 172 may be wound tight around the pulley 283.

In response to the pulley 283 rotating forward and backward, the wires 172 may be moved in two opposite directions. Accordingly, a pair of sliding elements 116 that are installed on either side of the door 150 may be elevated, and the doors 120, 130, 140, and 150 may be automatically elevated. In response to the doors 120, 130, 140, and 150 being automatically lifted up or down, the frame 110 may be opened or shut.

Figure 18:
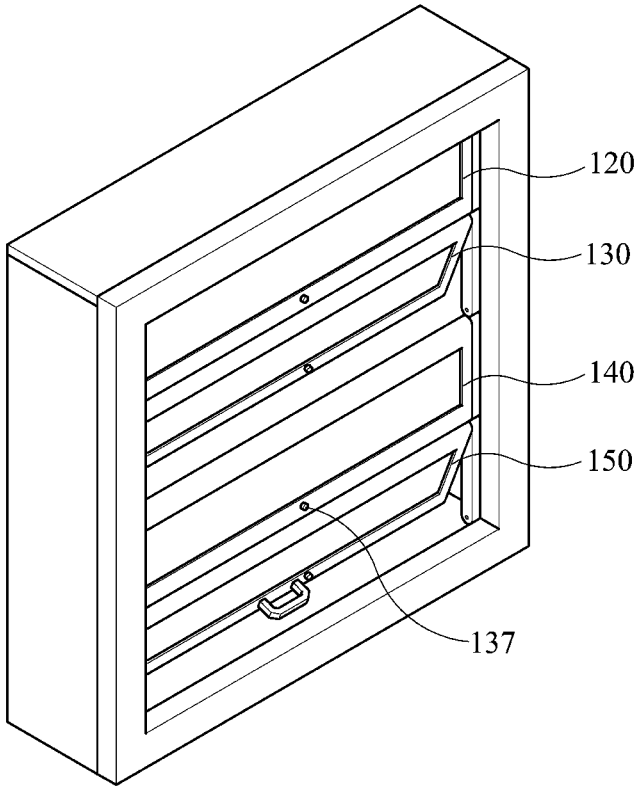
FIG. 18 is a perspective view illustrating an example of separately opening or shutting one or more doors of the multipurpose window illustrated in FIG. 1.
Figure 19:
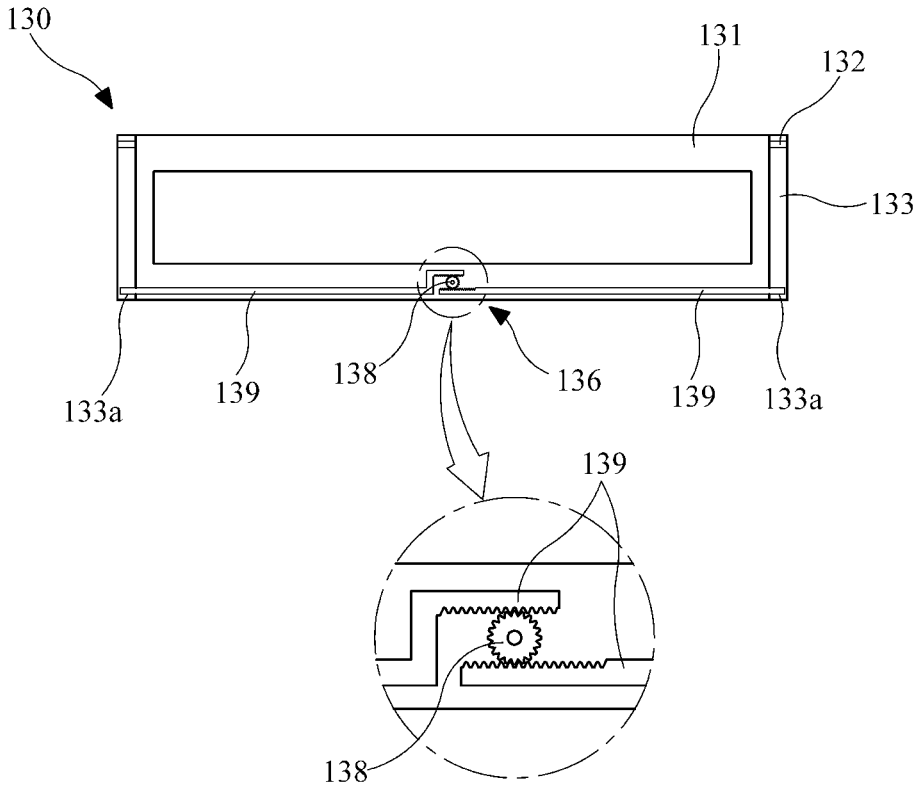
FIG. 19 is a plan view illustrating an example of a door that can be opened or shut individually.

Referring to FIG. 18, at least one of the doors 120, 130, 140, and 150 may be opened or closed separately by being hinged to their first link elements 161. For example, the door 130 may be configured to be able to be opened or closed separately. In this example, referring to FIG. 9, the door 130 may include a main body 131 and a pair of fixing brackets 133 that are hinged to both upper sides of the main body 131, and that are fixed to a pair of first link elements 161.

The main body 131 may pivot on the fixing brackets 133 to open or shut the frame 110. The fixing brackets 133 may be formed in one body with the first link elements 161. The fixing brackets 133 may be hinged to the main body 131 by inserting a hinge axis 132 that is formed in the main body 131 into an axis hole formed in each of the fixing brackets 133.

The door 130 may also include a lock device 136 that locks the door 130 to the first link elements 161 with the door 130 closed. The lock device 136 may lock the main body 131 to the fixing brackets 133 with the frame 110 being shut by the main body 131 of the door 130.

The lock device 136 may include a rotation lever 137, a pinion element 138, and a pair of rack elements 139. The pinion element 138 and the rack elements 139 may be installed at a lower part of the main body 131. The pinion element 138 may be axially coupled to the rotation lever 137. The rack elements 139 may engage the pinion element 138 from above and below the pinion element 138. The rack elements 139 may be installed such that they can be inserted into or removed from fixing grooves 133*a* of the fixing brackets 133 according to the direction of the rotation of the pinion element 138.

Accordingly, in response to the user rotating the rotation lever 137 to insert the rack elements 138 into the fixing grooves 133*a*, the main body 131 may be locked to the fixing brackets 133. In response to the user rotating the rotation lever 137 to remove the rack elements 138 from the fixing grooves 133*a*, the main body 131 may be unlocked from the fixing brackets 133.

Stoppers 134 may be installed at the hinges between the door 130 and the first link elements 161, and more particularly, at the hinges between the main body 131 and the fixing brackets 133. The stoppers 134 may maintain the main body 131 to be pivoted by a predetermined angle with respect to the fixing brackets 133.

Figure 20:
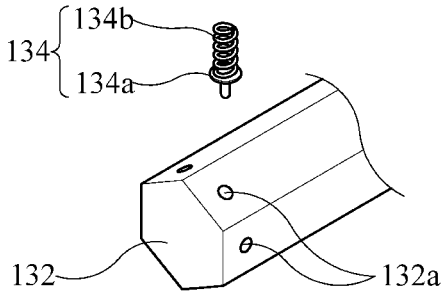
FIG. 20 is a perspective view of an example of a stopper illustrated in FIG. 19.

For example, referring to FIG. 20, a stopper 134 may include a protrusion 134*a* that is installed in an axis hole of a fixing bracket 133 and an elastic element 134*b* that elastically supports the protrusion 134*a*. For example, the elastic element 134*b* may be a spring. A hinge axis 132 of the main body 131 may have a polygonal cross-section, for example, a hexagonal cross-section. A seating groove 132*a* may be formed on each of the six sides of the hinge axis 132. In response to the main body 131 being pivoted by a predetermined angle with respect to the fixing brackets 133, the protrusion 134*a* may be inserted into one of the seating grooves 132*a* of the hinge axis 132, and may thus maintain the main body 131 to be pivoted by the predetermined angle with respect to the fixing brackets 133.

Figure 21:
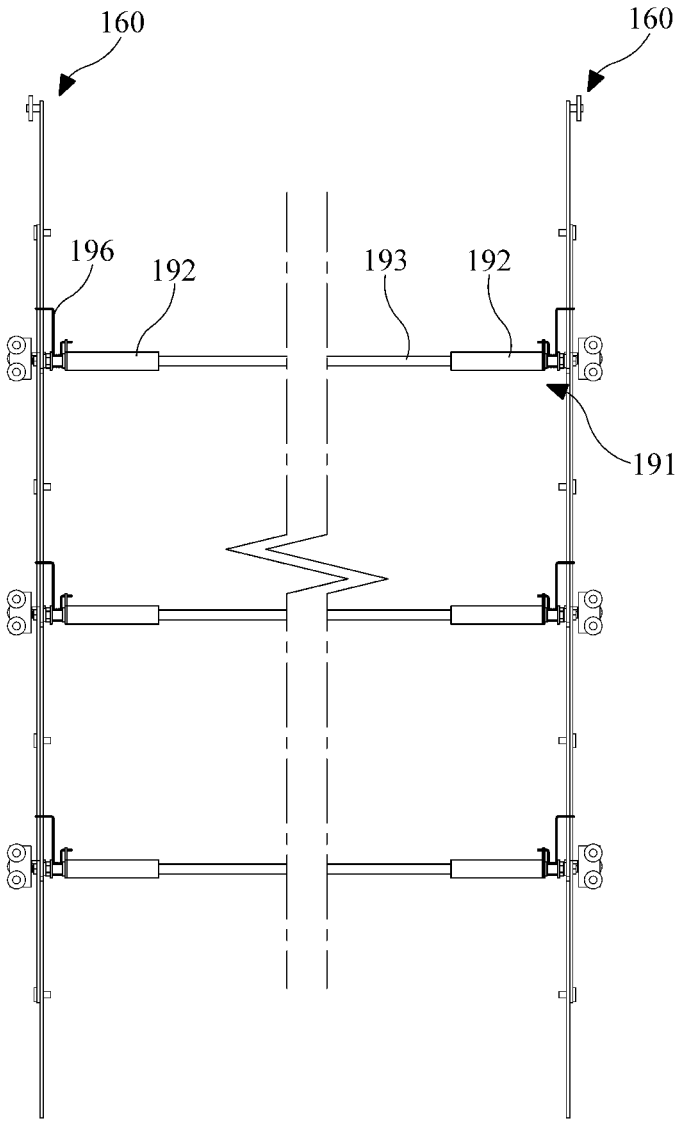
FIG. 21 is a front view illustrating an example of the multipurpose window illustrated in FIG. 1, including a linking device and a plurality of opening force reduction elements.
Figure 22:
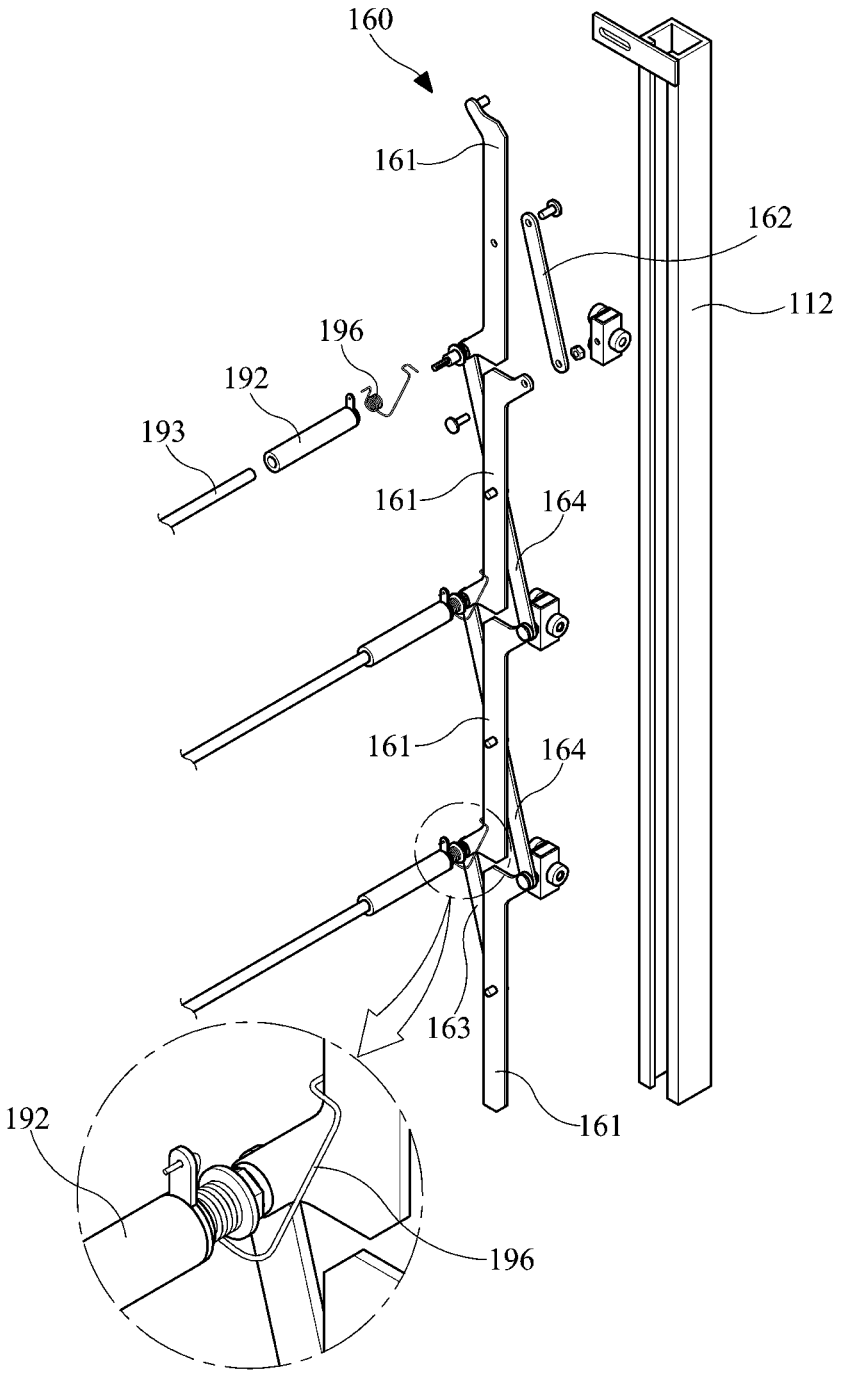
FIG. 22 is an exploded perspective view illustrating examples of the linking device and the opening force reduction elements illustrated in FIG. 21.

Referring to FIGS. 21 and 22, the multipurpose window 100 may also include a linking device 191 that links the link assemblies 160 to fold or unfold the link assemblies 160 at the same time.

The linking device 191 may include one or more pairs of linking axes 192 and one or more connecting bars 193. The pairs of linking axes 192 may be installed such that they can face hinges on the link assemblies 160 that rotate forward and backward in response to the link assemblies 160 being folded or unfolded.

For example, a first pair of linking axes 192 may be installed at the hinges between the lower ends of a pair of uppermost first link elements 161 and the upper ends of a pair of upper fourth link elements 164. In this example, the first pair of linking axes 192 may be fixed to the fourth link elements 164. Similarly, a second pair of linking axes 192 may be installed at the hinges between a pair of second uppermost first link elements 161 and a pair of lower fourth link elements 164, and a third pair of linking axes 192 may be installed at the hinges between a pair of third uppermost first link elements 161 and a pair of link elements 163.

The connecting bars 193 may connect the pairs of linking axes 192 between the link assemblies 160. Accordingly, the link assemblies 160 may be folded or unfolded at the same time in connection with one another to open or close the doors 120, 130, 140, and 150. As a result, the user can smoothly open or close the doors 120, 130, 140, and 150.

The length of the connecting bars 193 may be determined based on the distance between the link assemblies 160. For example, the connecting bars 193 may be formed to have such a length that they can be inserted into their respective pairs of linking axes 192. Grooves may be formed on the pairs of linking axes 192 or on the connecting bars 193 such that the connecting bars 193 can be inserted into their respective pairs of linking axes 192 or vice versa.

In response to the distance between the link assemblies 160 being changed due to a change in the width of the doors 120, 130, 140, and 150, the connecting bars 193 may be replaced with new connecting bars that can fit between the link assemblies 160. The new connecting bars may be configured to have such a length that they can be coupled to their respective pairs of linking axes 192 by being inserted thereinto.

The multipurpose window 100 may also include a plurality of opening force reduction elements 196 that reduces opening force in response to the user opening the doors 120, 130, 140, and 150. Referring to FIGS. 21 and 22, the opening force reduction elements 196 may be elastic elements. In this example, the elastic elements may be installed such that they can apply elastic force between the first link elements 161 and the third link elements 163 in a direction in which the first link elements 161 and the third link elements 163 are folded over each other and can apply elastic force between the first link elements 161 and the fourth link elements 164 in a direction in which the first link elements 161 and the fourth link elements 164 are folded over each other.

For example, the elastic elements may be torsion springs that are wound several times around and that have first ends fixed to the linking axes 192. In this example, second ends of the torsion springs may be installed across the first link elements 161 so as not to interfere with the folding or unfolding of the link assemblies 160. The torsion springs may be configured to apply elastic force between the first link elements 161 and the third link elements 163 in a direction in which the first link elements 161 and the third link elements 163 are folded over each other, and to apply elastic force between the first link elements 161 and the fourth link elements 164 in a direction in which the first link elements 161 and the fourth link elements 164 are folded over each other. The torsion springs may be configured to have sufficient elastic force to maintain the doors 120, 130, 140, and 150 to be closed.

Due to the elastic force reduction elements 196, it is possible to reduce the force that it takes to open the doors 120, 130, 140, and 150 by an amount corresponding to the elastic force of the opening force reduction elements 196. Thus, the user can open the doors 120, 130, 140, and 150 with less force.

The multipurpose window 100 may be installed such that the doors 120, 130, 140, and 150 can be swung open vertically. As another example, the multipurpose window 100 may be installed such that the doors 120, 130, 140, and 150 can be swung open horizontally.

The multipurpose window 100 may be applied to blinds. In this example, the doors 120, 130, 140, and 150 may be formed as plates using various materials such as a metal, wood, plastic, paper, fabric, or the like.

As described above, by completely unfolding link assemblies, it is possible to completely block the space between doors and between a frame and the doors and thus to provide wind protection and security.

By partially unfolding the link assemblies, it is possible to partially open the frame and the doors. Accordingly, it is possible to improve ventilation through the frame and the doors.

Since the doors swing outward and are inclined in parallel with one another, it is possible to prevent rain from coming in and further improve ventilation. In addition, it is possible to relieve concerns over privacy protection and save costs for heating and air-conditioning.

Moreover, by controlling the degree to which the frame is opened, it is possible to control ventilation, prevent break-ins and prevent children from accidentally falling out. Furthermore, it is possible to provide a multipurpose window having more excellent appearance and causing less discomfort than traditional barred windows.

By completely folding the link assemblies to completely open the frame, it is possible to further improve ventilation and allow people to climb out in case of a fire or an emergency.

It is possible to provide a multipurpose window having many advantages over traditional sliding and casement windows, such as small space of installation and better use of space.

Since the doors can be automatically opened or closed and can be opened or closed separately, it is possible to improve the convenience of the use of a multipurpose window. In addition, by providing a shock-absorbing device, it is possible to open or close the doors smoothly.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A multipurpose window, comprising:

a frame;

a plurality of doors configured to be arranged in a row in the frame;

a pair of link assemblies configured to be installed on both sides of each of the doors, configured to link the doors and configured to open or shut the frame by being folded or unfolded; and a linking device configured to link the link assemblies to fold or unfold the link assemblies at the same time, wherein:

each of the link assemblies comprises:

a plurality of first link elements configured to be installed on one side of each of the doors and include an outermost first link element, and that is hinged to the frame and one or more other first link elements that are slidably supported by the frame;

a second link element configured to be hinged to a center of the outermost first link element and configured to be hinged to a near end of a first link element that is adjacent to the outermost first link element;

a third link element configured to be hinged to a center of another outermost link element and configured to be hinged to a near end of a first link element that is adjacent to the another outermost first link element; and a fourth link element configured to be hinged to a center of a central first link element and to near ends of a pair of first link elements adjacent to the central first link element; and the linking device comprises:

at least one pair of linking axes configured to face hinges on the link assemblies that rotate forward and backward in response to the link assemblies being folded or unfolded; and at least one connecting bar configured to be coupled to the at least one pair of linking axes and configured to be replaceable according to a distance between the at least one pair of linking axes.

2. The multipurpose window of claim 1, wherein:

one or more first link elements whose ends are hinged to other first link elements, the second link element, the third link element, or the fourth link element are configured to have an extension that protrudes away from the doors to, in response to the link assemblies being unfolded, prevent the second and fourth link elements from interfering with each other and prevent the third and fourth link elements from interfering with each other; and the outermost first link element is configured to have an end that is hinged to the frame so as to be able to move forward and backward with respect to the frame.

3. The multipurpose window of claim 1, further comprising:

a balancing device configured to allow the doors to pivot open or closed in a balanced manner; and a braking device configured to put a brake on the doors to stop the doors at a predefined position, wherein the balancing device comprises:

wires configured to be fixed to both sides of one of the doors and configured to form a closed loop by extending, along the frame, from first fixed parts of the wires to a bottom of the frame, to an upper corner of the frame, to second fixed parts of the wires, to the bottom of the frame, to another upper corner of the frame, and to the first fixed parts of the wires; and a plurality of pulleys configured to be installed in the frame to guide the movement of the wires.

4. The multipurpose window of claim 3, wherein the braking device comprises:

a pressing element configured to be disposed on an interconnection of the wires; and a manipulation lever configured to attach the pressing element firmly to or detach the pressing element from the wires.

5. The multipurpose window of claim 3, wherein the braking device comprises:

a rotation motor;

a pressing element configured to be disposed on an interconnection of the wires, configured to be screw-coupled to a driving axis that is rotated by the rotation motor, and configured to be attached firmly to or detached from the wires according to the rotation direction of the driving axis; and an auxiliary bracket configured to support the driving axis in the frame and guide the movement of the pressing element.

6. The multipurpose window of claim 1, further comprising:

a shock-absorbing device configured to prevent the doors from being opened or closed abruptly.

7. The multipurpose window of claim 1, further comprising:

a reciprocating device configured to reciprocate one of the plurality of first link elements to allow the frame to be automatically opened or closed.

8. The multipurpose window of claim 1, wherein:

at least one door is configured to be hinged to a first link element to be opened or closed separately; and the multipurpose window further comprises:

a stopper configured to be installed at a hinge between the at least one door and the first link element and configured to maintain the at least one door to be pivoted by a predetermined angle; and a lock device configured to lock the at least one door to the first link element with the frame closed.

9. The multipurpose window of claim 1, further comprising:

one or more opening force reduction elements configured to reduce opening force that is generated in response to the doors being opened, wherein the opening force reduction elements are further configured to apply elastic force between the plurality of first link elements and the third link element in a direction in which the plurality of first link elements and the third link element are folded over each other and to apply elastic force between the plurality of first link elements and the fourth link element in a direction in which the plurality of first link elements and the fourth link element are folded over each other.

* * * * *